United States Patent [19]

Carlson

[11] Patent Number: 4,921,451

[45] Date of Patent: May 1, 1990

[54] IN-LINE FUSE HOLDER

[76] Inventor: Russell L. Carlson, 68 Minwood Dr., Tallmadge, Ohio 44278

[21] Appl. No.: 222,059

[22] Filed: Jul. 8, 1988

[51] Int. Cl.[5] ..... H01R 13/68

[52] U.S. Cl. ..... 439/621; 337/187

[58] Field of Search ..... 337/187, 188, 193, 201, 337/191, 192, 216; 439/621, 622

[56] References Cited

U.S. PATENT DOCUMENTS

| | | | |
|---|---|---|---|
| 3,356,806 | 12/1967 | Urani | 337/192 |
| 3,710,296 | 1/1973 | Urani | 337/188 |
| 4,372,638 | 2/1983 | Sohler | 439/621 |
| 4,391,485 | 7/1983 | Urani | 439/621 |
| 4,560,227 | 12/1985 | Bukala | 439/621 |

FOREIGN PATENT DOCUMENTS

| | | | |
|---|---|---|---|
| 2511459 | 9/1976 | Fed. Rep. of Germany | 439/622 |

*Primary Examiner*—Gary F. Paumen

*Attorney, Agent, or Firm*—Oldham & Oldham Co.

[57] ABSTRACT

In-line fuse holders for two-bladed fuses are disclosed which can be fastened in series to an electrical wire by severing the wire in which the holder is to be incorporated, inserting the severed ends of the wire into the holder, and mechanically fastening the wire securely in the holder. Various embodiments are shown including holders in which the wires are connected with sliding guillotine blades, and those in which fastening is secured by crimping. Several of the embodiments include cover flaps which hold fuses inserted in the holders securely in place.

3 Claims, 2 Drawing Sheets

IN-LINE FUSE HOLDER

TECHNICAL FIELD

This invention relates to overload protection devices which protect wired electrical circuits from excessive amperage. More particularly, this invention relates to in-line fuse holder devices adapted to use two-bladed fuses of the "see-through" type. Specifically, this invention relates to in-line fuse holders which can be connected into electrical circuits simply by cutting an electric wire in the circuit and mechanically connecting each end of the severed wire directly to the fuse holder.

BACKGROUND OF THE INVENTION

Occasionally, electric circuits are subjected to inadvertant high amperage loads which have the capability of damaging the circuit and devices connected to it, and which not infrequently produce sufficient heat to result in fires. To avoid such possibilities, overload protection devices, including circuit breakers, fuses, and the like which either fail, or "trip" when subjected to overload conditions, have long been employed. In those instances where fuses are used to protect the circuit, several systems for incorporating the fuses into the circuit are commonly used. One such system involves the placement of a group of fuses, protecting a number of circuits, at a single location or "fuse block". While the use of a fuse block has certain advantages, including the ability to examine the condition of fuses in multiple circuit, simultaneously, its use has the significant disadvantage of requiring part of each of the circuits protected to pass through the fuse block. Such requirement frequently necessitates long runs of wire from the area where the electric power provided by the circuit is used, to a fuse block remote from such area, often a time-consuming and expensive undertaking.

A different system of fuse protection involves the use of the so-called "in-line" fuse, which allows the fuse to be located at any point in the circuit, rather than requiring location at a single point such as a fuse block. In-line fuses are available in several forms, one commonly used being that of the ferrule type, a glass cylinder with metal ends having a fusable link connected therebetween, typically held in a "bayonet-type" holder fitted with a wire at each end which is spliced into the circuit line. Unfortunately, bayonet-type holders are frequently difficult to open when a damaged fuse needs to be replaced. In addition, the wires connected to the bayonet holder must each be spliced into the line, a time consuming operation. Furthermore, the multiple connections entailed in using bayonet holders, involving both the connection of the wires to the metal ends of the holders, as well as the connections required to splice the wires into the circuit wire, commonly produces appreciable and undesirable electrical resistance in the circuit. While use has also been made of holders designed to receive "doubled-bladed" fuses, such holders also have been connected to wires which require splicing into the circuit line, as in the case of the bayonet holders, again creating the potential for high resistance circuits.

DISCLOSURE OF THE INVENTION

In view of the preceding, it is a first aspect of this invention to provide an in-line fuse holder that can be directly connected into a wire used in an electric circuit.

A second aspect of the invention is to provide an in-line fuse holder than can be directly attached to an electric wire by mechanical connection means which require no solder.

Another aspect of the invention is to furnish an in-line fuse holder which can be removed from an electric wire in which it is installed and re-used in a different electric wire.

A further aspect of the invention is the provision of an in-line fuse holder having a protective cover flap that protects and secures the double-bladed fuse in the fuse holder.

The foregoing and other aspects of the invention are provided by an in-line fuse holder comprising:

- a body member having two holes therein capable of receiving inserted electric wires;
- mechanical connection means for fastening electric wires inserted in said holes to said body member while maintaining said wires apart from each other, and
- two blades slots extending from the outside of said body to the location at which said wires are fastened within said holes, wherein said blade slots are slots adapted to receive the blades of a double-bladed fuse, and which permit each of said blades to effect electrical contact with one of the wires inserted in said holes, thereby completing the electrical connection between said wires.

Other aspects of the invention are obtained by means of an electric circuit which includes as a part thereof the in-line fuse holder of the preceding paragraph.

BRIEF DESCRIPTION OF THE DRAWINGS

The invention will be better understood when reference is had to the following drawings, in which like parts have like numbers.

DETAILED DESCRIPTION OF THE INVENTION

Figure 1:
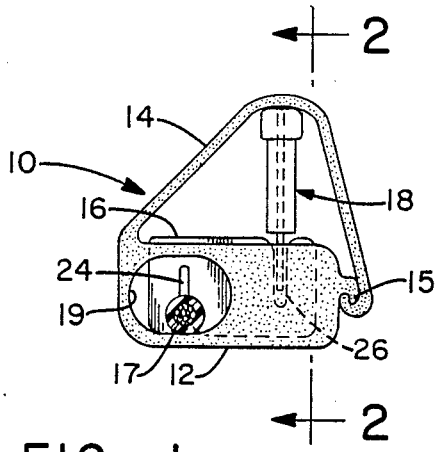
FIG. 1 is a side elevation of one of the fuse holders of the invention illustrating a double-based fuse installed therein.

FIG. 1 shows a side elevation of one embodiment of the fuse holder of the invention, generally 10, illustrating a double-bladed fuse, generally 18, installed therein. As shown in the Figure, fuse holder 10 includes a body 12 to which is integrally attached cover flap 14. The cover flap 14 is folded over fuse 18, holding the fuse securely in the holder and providing electrical insulation to the assembly, while its free end is snapped over latch 15, holding the cover flap in place.

Holder 10 includes as a component thereof guillotine blade 16 which holds electric wire 17 in place by means of wire slot 24, and which provides means, fuse blade slit 26, for holding the fuse 18 in place.

While holder 10 may be fabricated to accomodate a wide variety of electric wires, it is especially suited for use with 10 to 22 gauge wire, and although other types of wire may be employed, the holder is particularly adapted to use with stranded wire.

While the transverse cross section of body 12 is shown in the Figure to be generally rectangular in shape, other shapes, for example, elliptical, round etc. could also be used.

Figure 2:
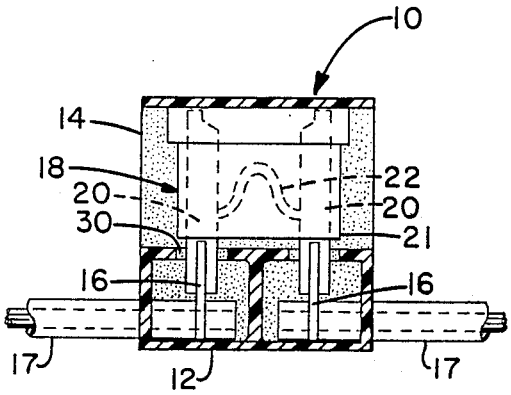
FIG. 2 is a cross sectional view of the fuse holder of FIG. 1, along line 2—2 of FIG. 1.

FIG. 2 is a cross sectional view of the fuse holder 10 of FIG. 1 along line 2—2 of the latter Figures. As shown, the fuse holder 10 comprises a body portion 12, with attached cover flap 14. As previously described, the cover flap f24 extends over the top of the double-bladed fuse 18, holding the fuse securely in place. Fuse 18, typically designed to accomodate from 5 to 40 amps of current, consists of two blade components 20, connected by a fusible link 22, the top portion of the fuse being encased in a transparent plastic case 21. The lower portion of each one of the blade members 20 of fuse 18 engage and make electrical contact with the guillotine blades 16, the guillotine blades also engaging and making electrical contact with the electric wires 17. The electrical circuit is thus completed from one of the electric wires 17, through one of the guillotine blades 16 to one of the blades 20; then through the fusible link 22 to the other fuse blade 20; from the latter fuse blade to the other guillotine blade 16, and finally to the other electric wire 17.

The dimensions of the fuse holder 10 will depend upon the dimensions of the fuse with which it is to be used, the diameter of the wires connected, and similar considerations. Generally, however, the body will be from about 1 to 1½ inches long and the holes provided for wire insertion will have an internal diameter of about ⅛ inch. In such a body, the guillotine blade may be about 3/16 inch high and about 5/16 inch wide. The wire and fuse blade slits in such a guillotine blade may conveniently be about ⅛ inch deep and spaced about ⅛ inch apart. The blade slots for the holder described will typically be about 3/16 inch long and be spaced from each other about ⅛ inch.

Figure 3:
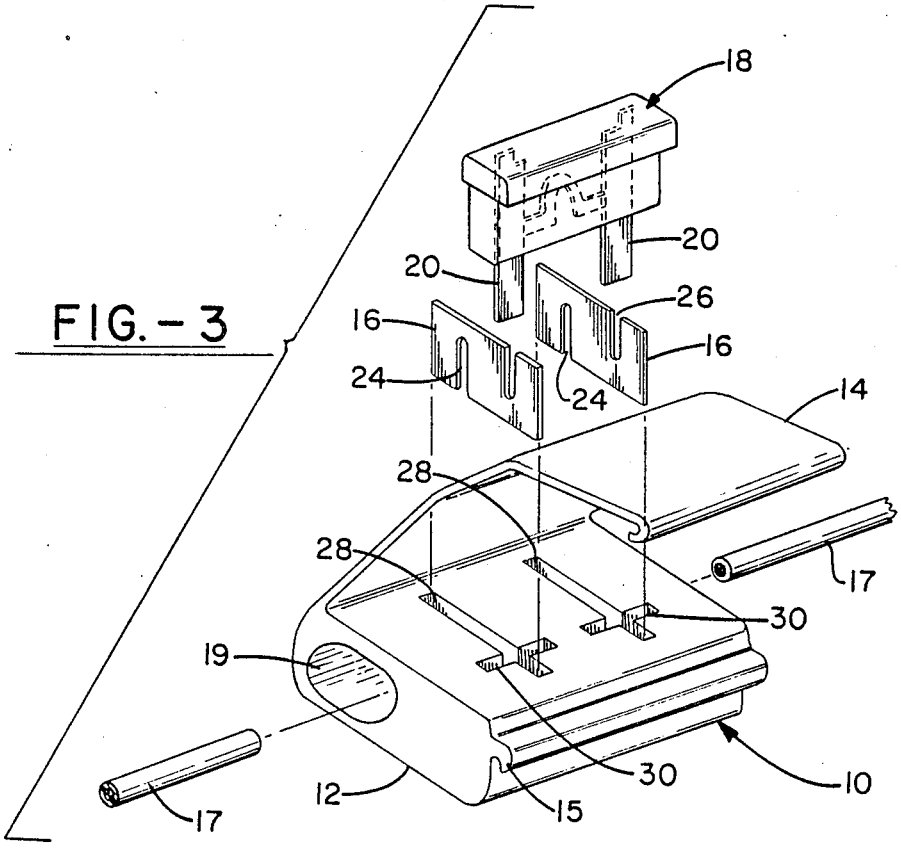
FIG. 3 is an exploded view of the fuse holder and the double-bladed fuse of FIG. 1.

FIG. 3 is an exploded view of the fuse holder 10 clearly showing the functioning of the various parts of the assembly. As is suggested by the Figure, wires 17 are inserted in wire holes 19, after which guillotine blades 16 are pushed downward through guillotine slots 28, causing wire slits 24 to mechanically connect wires 17 to body 12, at the same time establishing electric contact between the wires and the blades. Fuse 18 is thereupon inserted in blade slots 30 bringing the blades 20 into mechanical and electrical contact with fuse blade slits 26. Cover flap 14 is then bent over fuse 18 and its edge snapped over latch 15, securing the flap in place.

Various materials having appropriate dielectric properties may be employed for fabricating the fuse holder 10; however, plastics, for example, polyolefins such as polyethylene, polypropylene, and the like, as well as PVC, nylon, and others, are particularly suitable for the purpose.

Figure 4:
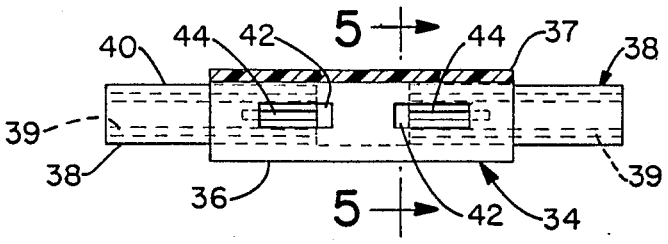
FIG. 4 is a cross sectional view of another embodiment of the fuse holder of the invention, along line 4—4 of FIG. 5.
Figure 5:
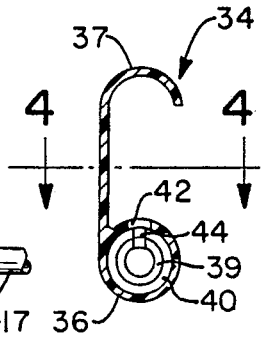
FIG. 5 is a cross sectional view of the embodiment shown in FIG. 4, along line 5—5 of FIG. 4.

FIG. 4 shows a cross sectional view of another embodiment of the fuse holder of the invention, generally 34, along line 4—4 of FIG. 5. The fuse holder of the embodiment, indicated generally by the numeral 34, comprises a coupling sleeve 36, on each end of which are inserted wire connectors, generally 38, which include a metal liner 39 positioned on the inside of a hollow cylindrical tube 40. Coupling sleeve 36, which securely holds wire connectors 38 inside its ends by frictional engagement, has two blade slots 42 positioned on the top thereof which communicate from the outer to the inner surface of the coupling sleeve. The hollow cylindrical tube 40 and metal liner 39 are also provided with blade slots 44 immediately below blade slots 42, so that fuse blades inserted into the blade slots 42 of the coupling sleeve 36 can communicate through blade slots 44, establishing electrical contact between the fuse blades and the metal liners 39.

While the dimensions of the fuse holder 34 will depend upon the size of the fuse employed, as well as other considerations, and may be varied within a broad range, ordinarily, coupling sleeve 36 will be about 1 to 1½ inches long and have inside and outside diameters, respectively, of about 3/16 inch and about ¼ inch. In such a coupling sleeve, the wire connector will typically be about ¾ inch to 1 inch long, and have inside and outside diameters, respectively, of about ⅛ inch and 3/16 inch. The inside and outside diameters of the liner for the fuse holder described will be, respectively, about 1/16 inch and ⅛ inch. While a single blade slot 42 wide enough to accomodate both of the fuse blades may be employed, commonly two such slots as illustrated in the Figure will be used, each being about 3/16 inch wide spaced at a distance of about ⅛ inch from each other.

FIG. 5 indicates a cross sectional view of the embodiment shown in FIG. 4 along line 5—5 of FIG. 4. The Figure shows coupling sleeve 36 enveloping the hollow cylindrical tube 40 with its metal liner 39. The relationship of blade slot 40 and blade 44 is also shown more clearly, indicating how the fuse blades of the fuse extend through the slots and make contact with the metal liner to compete the electrical circuit through the fuse. Cover flap 37 is adapted to snap over the top of a double-bladed fuse inserted in fuse holder 34, securing the fuse in the holder. While a "J" shaped cover flap 37 is shown, other shapes might also be used, including one which would be temporarily engageable with coupling sleeve 36, as through provision of a latch lip similar to 15 shown in FIG. 1. As in the case of the fuse holder of FIG. 1 a different latch mechanism could be used, including any of those well known in the art.

Figure 6:
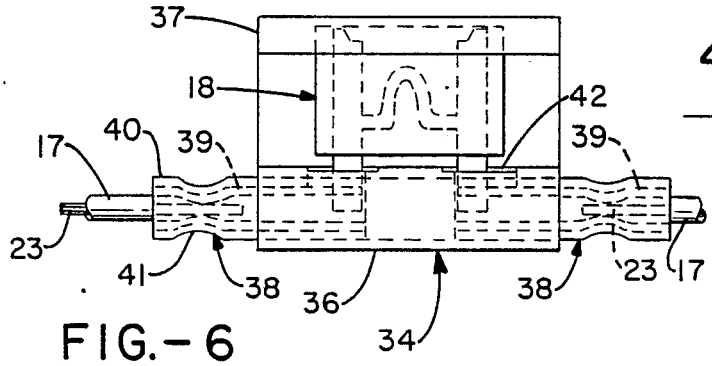
FIG. 6 is a front elevation of the fuse holder shown in FIG. 4 with a double-bladed fuse inserted therein.

FIG. 6 shows a front elevation of the fuse holder 34, including a double-bladed fuse 18 inserted therein.

In the process of inserting the fuse holder 34 into an electric circuit, electric wires 17 are prepared so that the ends of the wire 23 are free from insulation. The wires are then inserted into the ends of the wire connectors 38 so that the wire ends make metal-to-metal contact with metal liners 39. The wire connectors 38 are then mechanically crushed or "crimped", establishing positive electrical contact between the metal liner and the electric wire, while at the same time securely fastening the electric wire within the wire connector. A double-bladed fuse 18 is then inserted in the blade slots of coupling sleeve 36, and cover flap 37 is snapped over the top of the fuse.

As in the case of the fuse holder of FIG. 1, the coupling sleeve 36 and the cover flap 37 integrally attached thereto, as well as the hollow cylindrical tubes 40 may be made from any suitable electrically non-conductable material, with plastic materials being preferred, including nylon, PVC, polyolefins and others.

Figure 7:
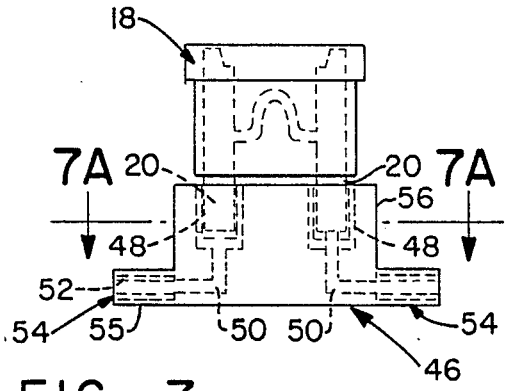
FIG. 7 is a front elevation of still another embodiment of a fuse holder of the invention with a double-bladed fuse inserted therein.
Figure 7A:
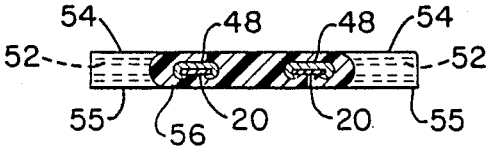
FIG. 7A is a cross-section of the body portion of the fuse holder of FIG. 7 along line 7A—7A of the Figure.

FIG. 7 shows a front elevation of a third embodiment of a fuse holder of the invention, generally 46, also shown with a double-bladed fuse 18 inserted therein. As in the case of the fuse holder of FIG. 6, the fuse holder of embodiment 46 is a "Tee" shaped, being comprised of a body portion 56, and wire connectors 54 extending from the bottom of each side thereof. As with the wire connectors of the embodiment 34, the wire connectors 54 of embodiment 46 include a hollow cylindrical tube portion 55, surrounding a metal liner 52. Metal liner 52 is connected to blade connectors 48 by a strip of metal 50. The fuse blades 20 of fuse 18 are inserted into blade connectors 48, which is more clearly illustrated in FIG. 7A, a cross section of the body portion 56 along line 7A—7A of FIG. 7. The blade connectors 48 are metal clips which securely engage the fuse blades 20 of fuse 18, assuring good electrical contact between the blades and the clips.

Again, the dimensions of holder 46 will depend upon the size of the fuse inserted therein, as well as other considerations, and may be varied to a considerable degree; however, normally the body portion will be about $\frac{3}{4}$ inch to 1 inch wide, and about $\frac{1}{2}$ inch to $\frac{3}{4}$ inch high. The wire connectors ordinarily will be about $\frac{1}{2}$ inch to $\frac{3}{4}$ inch long, and will otherwise have the dimensions of those described in connection with FIG. 4.

Figure 8:
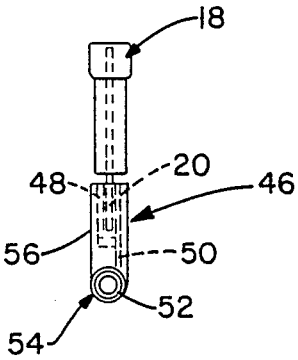
FIG. 8 is a side elevation of the fuse holder and double-bladed fuse of FIG. 7.

FIG. 8 illustrates a side elevation of the fuse holder and double-bladed fuse of FIG. 7. As shown, blade connector 48 is attached to the metal liner 52 by connector strip 50, the whole being encased in body portion 56. Fuse blades 20 of fuse 18 are inserted into blade connector 48, providing electrical contact between the blades and the metal liner.

While in accordance with the patent statutes a preferred embodiment and best mode has been presented, the scope of the invention is not limited thereto, but rather is measured by the scope of the attached claims.

What is claimed is:

1. An in-line fuse holder comprising:

an insulative body member adapted to receive inserted electrical wires;

two blade slots extending from the outer surface of said body member to a location therein, wherein said blade slots include metal blade connectors adapted to receive the flag blades of a double-bladed fuse, and said blade slots permit each of said blades to effect electrical contact with one of the wires;

and further wherein said metal blade connectors are spaced from each other and each of said blades connectors is connected to a respective metal liner tube of a respective wire connector by means of a respective metal strip, said wire connectors being unitary with said body member and comprising crimpable, hollow cylindrical tubes each having a said metal liner tube disposed on the interior thereof, said wire connectors being adapted to receive and to crimp thereto the wires when inserted therein, wherein when the double-bladed fuse is inserted in said fuse holder, an electrical connection is completed between the wires and the fuse.

2. An in-line fuse holder according to claim 1 wherein said body member and the hollow cylindrical tubes of said wire connectors are formed from plastic.

3. An electrical circuit which includes as a part thereof the in-line fuse holder of claim 1.

* * * * *